United States Patent [19]

Sasaki et al.

[11] 4,363,859

[45] Dec. 14, 1982

[54] ELECTROPHOTOGRAPHIC PHOTOCONDUCTOR

[75] Inventors: Masaomi Sasaki, Kawasaki; Kyoji Tsutsui, Tokyo, both of Japan

[73] Assignee: Ricoh Company, Ltd., Tokyo, Japan

[21] Appl. No.: 951,301

[22] Filed: Oct. 13, 1978

[30] Foreign Application Priority Data

Oct. 22, 1977 [JP] Japan ..... 52-126946

[51] Int. Cl.[3] ..... G03G 5/10

[52] U.S. Cl. ..... 430/59; 430/64; 430/77; 430/79

[58] Field of Search ..... 430/58, 71, 72, 59, 430/77, 79, 64

[56] References Cited

U.S. PATENT DOCUMENTS

| | | | |
|---|---|---|---|
| 3,484,237 | 12/1969 | Shattuck et al. | 430/80 |
| 3,775,105 | 11/1973 | Kukla | 430/80 |
| 3,791,826 | 2/1974 | Cherry et al. | 430/65 |
| 3,824,099 | 7/1974 | Champ et al. | 430/58 |
| 3,837,851 | 9/1974 | Shattuck et al. | 430/59 |
| 3,850,630 | 11/1974 | Regensburger et al. | 430/58 |
| 3,871,882 | 3/1975 | Wiedemann | 430/59 |
| 3,877,935 | 4/1975 | Regensburger et al. | 430/58 |
| 3,879,200 | 4/1975 | Regensburger et al. | 430/58 |
| 3,887,366 | 6/1975 | Champ et al. | 430/31 |
| 3,888,665 | 6/1975 | Wiedemann | 430/59 |
| 3,894,868 | 7/1975 | Regensburger | 430/78 |
| 3,895,944 | 7/1975 | Wiedemann et al. | 430/59 |
| 3,898,084 | 8/1975 | Champ et al. | 430/31 |
| 3,904,407 | 9/1975 | Regensburger et al. | 430/58 |
| 3,923,762 | 12/1975 | Stolka et al. | 96/1.5 R |
| 3,928,034 | 12/1975 | Regensburger et al. | 430/65 |
| 3,937,631 | 2/1976 | Eisenhut | 430/58 |
| 3,955,978 | 5/1976 | Rochlitz et al. | 430/59 |
| 3,972,717 | 8/1976 | Wiedemann | 430/65 |
| 3,973,959 | 8/1976 | Rochlitz et al. | 430/58 |
| 3,977,870 | 8/1976 | Rochlitz | 430/59 |
| 3,989,520 | 11/1976 | Rochlitz | 430/58 |
| 3,996,049 | 12/1976 | Rochlitz | 430/59 |
| 4,046,564 | 9/1977 | Turner | 96/1.5 R |
| 4,052,210 | 10/1977 | Hectors | 430/72 |
| 4,075,012 | 2/1978 | Turner et al. | 96/1.5 R |
| 4,251,614 | 2/1981 | Sasaki et al. | 430/58 |
| 4,272,598 | 1/1981 | Sasaki et al. | 430/78 |

FOREIGN PATENT DOCUMENTS

| | | | |
|---|---|---|---|
| 51-94829 | 8/1976 | Japan | 430/58 |

*Primary Examiner*—John E. Kittle
*Assistant Examiner*—John L. Goodrow
*Attorney, Agent, or Firm*—Oblon, Fisher, Spivak, McClelland & Maier

[57] ABSTRACT

An electrophotographic photoconductor comprises an electroconductive supporting material and a photoconductive layer containing a charge carrier producing pigment and a charge transporting material therein, which is formed on the electroconductive supporting material. As the charge carrier producing pigment, azo pigments and other materials which are known as the charge carrier producing pigments are employed. As the charge transporting material, anthracene compounds which are represented by the general formula are employed, wherein X represents H (hydrogen) or a halogen atom and R represents an unsubstituted phenyl radical, a substituted phenyl radial having a halogen substituent, a cyano substituent, a lower dialkyl amino substituent with one to four carbon atoms, a lower alkoxyl substituent with one to five carbon atoms, and nitro substituent, a napthyl radical, an anthryl radical, and a carbazoyl radical.

In one embodiment of an electrophotographic photoconductor according to the present invention, the charge carrier producing pigment is dispersed in the photoconductive layer and in another embodiment of an electrophotographic photoconductor according to the present invention, the photoconductive layer essentially consists of a charge carrier producing layer and a charge transporting layer.

14 Claims, 3 Drawing Figures

ELECTROPHOTOGRAPHIC PHOTOCONDUCTOR

BACKGROUND OF THE INVENTION

The present invention relates to an electrophotographic photoconductor and more particularly to an electrophotographic photoconductor comprising an electroconductive supporting material and a photoconductive layer containing a charge carrier producing pigment and a charge transporting material therein, which is formed on the electroconductive supporting material.

Conventionally, various electrophotographic photoconductors have been developed for use in various electrophotographic copying methods. However, they still have their own shortcomings. For instance, a selenium-base photoconductor is not flexible enough for use in a sheet-like form. Furthermore, it is vulnerable and poor in heat resistance. In the case of a zinc oxide base photoconductor, it is not durable enough for use in printing and its photosensitivity is not high enough.

Recently, a charge transporting complex type photoconductor consisting of an electron accepting compound and an electron donor compound has been developed, but its photosensitivity is not yet satisfactory for practical use.

SUMMARY OF THE INVENTION

It is therefore a primary object of the present invention to provide an electrophotographic photoconductor, eliminating the above-mentioned shortcomings of the conventional electrophotographic photoconductors.

According to the present invention, anthracene compounds, which are conventionally employed as the photoconductive materials, are utilized as the charge transporting compounds in combination with charge carrier producing pigments.

To be more specific, in the present invention, the electrophotographic photoconductor comprises an electroconductive supporting material and a photoconductive layer containing a charge carrier producing pigment and a charge transporting material therein, which is formed on the electroconductive supporting material. As the charge carrier producing pigment, azo pigments are employed. Instead of the azo pigments, materials which are known as the charge carrier producing pigments, such as selenium, cadmium sulfate or the other inorganic or organic pigments, can be employed as well. As the charge transporting materials, anthracene compounds which are represented by the general formula

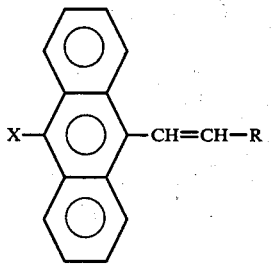

are employed, wherein X represents H (hydrogen) or a halogen atom and R represents an unsubstituted radical, a substituted phenyl radical having a halogen substituent, a cyano substituent, a lower dialkyl amino substituent with one to four carbon atoms, a lower alkoxyl substituent with one to five carbon atoms, and a nitro substituent, a naphthyl radical, an anthryl radical, and a carbazoyl radical.

In one embodiment of an electrophotographic photoconductor according to the present invention, the charge carrier producing pigment is dispersed in the photoconductive layer.

In another embodiment of an electrophotographic photoconductor according to the present invention, the photoconductive layer essentially consists of a charge carrier producing layer containing the charge carrier producing pigment, and a charge transporting layer containing the charge transporting material.

According to the present invention, a high photosensitivity is attained and fatigue caused by repetition of a cycle of charging and exposure of the photoconductor is reduced significantly.

BRIEF DESCRIPTION OF THE DRAWINGS

For a better understanding of the invention as well as other objects and further features thereof, reference is had to the following detailed description of the invention to be read in connection with the accompanying drawings, wherein.

DETAILED DESCRIPTION OF PREFERRED EMBODIMENTS

Figure 1:
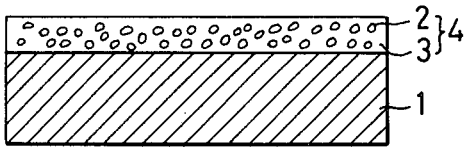
FIG. 1 is an enlarged schematic sectional view of a dispersed type electrophotographic photoconductor according to the present invention.

In the present invention, the electrophotographic photoconductor comprises an electroconductive supporting material and a photoconductive layer containing a charge carrier producing pigment and at least one charge transporting anthracene compound.

Charge Transporting Anthracene Compounds

The charge transporting anthracene compounds that can be employed in the present invention are represented by the general formula:

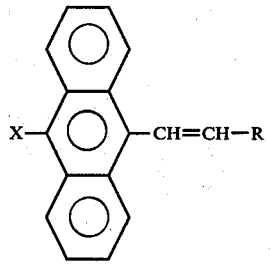

wherein X represents H (hydrogen) or a halogen atom and R represents an unsubstituted phenyl radical, a substituted phenyl radical having a halogen substituent, a cyano substituent, a lower dialkyl amino substituent with one to four carbon atoms, a lower alkoxyl substituent with one to five carbon atoms, and a nitro substituent, a naphthyl radical, an anthryl radical, and a carbozoyl radical.

The charge carrier producing pigments here mean pigments which are capable of producing charge carriers under illumination, and the charge transporting compounds mean compounds which are capable of accepting the charge carriers produced by the charge carrier producing pigments and transporting the charge carriers intermolecularly.

The charge transporting compounds which can be employed in the present invention are such compounds as are disclosed, as the photoconductive materials for use in electrophotography, in Japanese laid-open patent application Nos. 51-94829 and 51-98260, and the examples of the charge transporting compounds are listed in Table 1.

TABLE 1

| Charge Transporting Compounds (Formula) | (Name) |
|---|---|
| 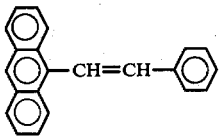 | 9-styryl anthracene |
| 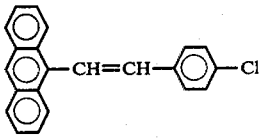 | 9-(4-chlorostyryl) anthracene |
| 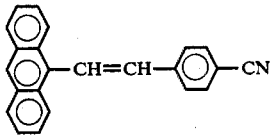 | 9-(4-cyanostyryl) anthracene |
| 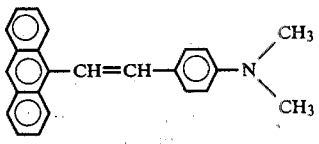 | 9-(4-dimethylamino styryl) anthracene |
| 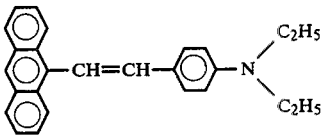 | 9-(4-diethylamino styryl) anthracene |
| 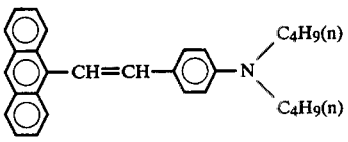 | 9-(4-di-n-buthylamino styryl) anthracene |
| 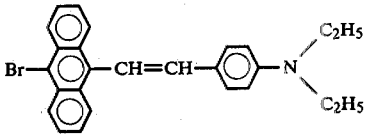 | 10-bromo-9-(4-diethyl-aminostyryl) anthracene |

TABLE 1-continued

| Charge Transporting Compounds (Formula) | (Name) |
|---|---|
| 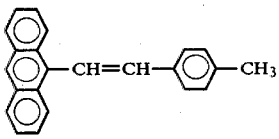 | 9-(4-methylstyryl anthracene |
| 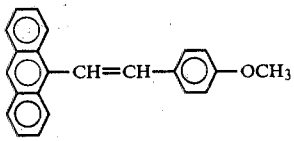 | 9-(4-methoxystyryl) anthracene |
| 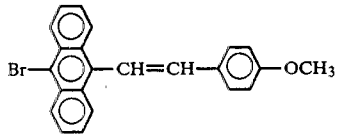 | 10-bromo-9-(4-methoxy-styryl) anthracene |
| 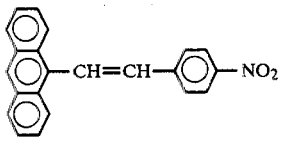 | 9-(4-nitrostyryl) anthracene |
| 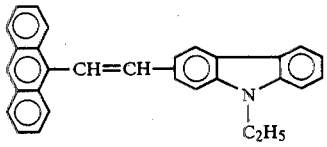 | α[3-(9-ethylcarbazoyl)]-β-(9-anthryl) ethylene |
| 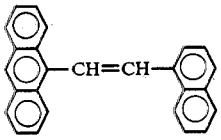 | α-(9-anthryl)β-(1-napthyl) ethylene |
| 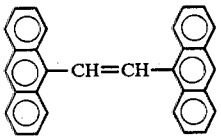 | α,β-bis(9-anthryl) ethylene |

Charge Carrier Producing Pigments

The charge carrier producing pigments which can be employed in combination with the above-mentioned charge transporting anthracene compounds in the present invention are the conventional pigments, for example:

1. Azo pigments having a carbazole group as represented by the general formula:

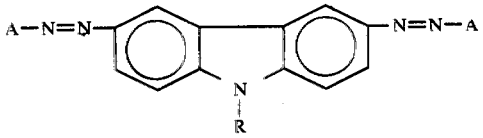

(U.S. patent application Ser. No. 872,679).

2. Azo pigments having a styrylstilbene group as represented by the general formula:

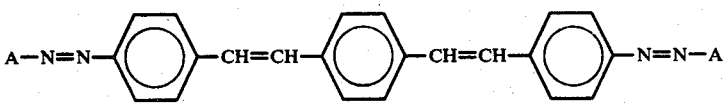

(U.S. patent application Ser. No. 898,130).

3. Azo pigments having a triphenylamine group as represented by the general formula:

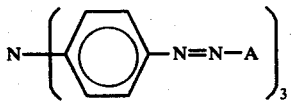

(U.S. patent application Ser. No. 897,508).

4. Azo pigments having a dibenzothiophene group as represented by the general formula:

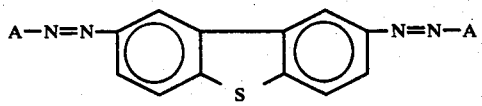

(U.S. patent application Ser. No. 925,157).

5. Azo pigments having an oxadiazole group as represented by the general formula:

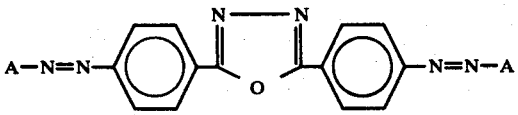

(U.S. patent application Ser. No. 908,116).

6. Azo pigments having a fluorenone group as represented by the general formula:

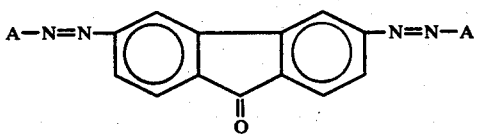

(U.S. patent application Ser. No. 925,157).

7. Azo pigments having bis-stilbene groups as represented by the general formula:

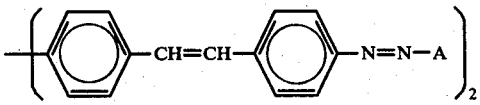

(U.S. patent application Ser. No. 922,526).

8. Azo pigments having distyrylphenyloxadiazole group as represented by the general formula:

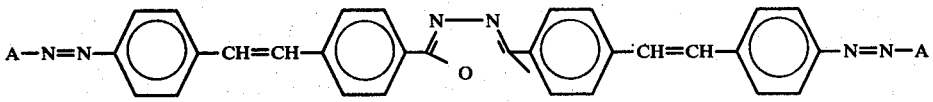

(U.S. patent application Ser. No. 908,116).

9. Azo pigments having a distrylcabazole group as represented by the general formula:

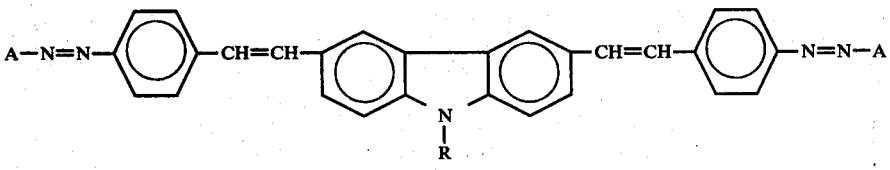

(U.S. patent application Ser. No. 921,086).

In addition to the above-mentioned azo pigments, the following materials can be employed as the charge carrier producing pigments.

Inorganic pigments, selenium, selenium-tellurium, cadmium sulfate and cadmium sulfate-selenium, Organic pigments, azo pigments, such as C. I. Pigment Blue-25 (Color Index C. I. 21180 or Diane Blue), C.I. Pigment Red 41 (C. I. 21200), C. I. Acid Red 52 (C. I. 45100) and C. I. Basic Red 3 (C. I. 45210), phthalocyanine pigments, such as C. I. Pigment Blue 16 (C. I. 74100), indigo pigments, such as C. I. Vat Brown 5 (C. I. 73410) and C. I. Vat Dye (C. I. 73030), perylene pigments, such as Scarlet B (commercially available from Bayer A. G.) and Indanthren Scarlet R (commercially available from Bayer A. G.).

The photosensitive materials according to the present invention are characterized by the combined use of the charge carrier producing compounds and the charge transporting materials and their constructions are classified into a dispersed type and a double layered type.

The dispersed type comprises a photosensitive layer in which fine particles of a charge carrier producing pigment are dispersed in a charge transporting medium and an electroconductive support material for supporting the photosensitive layer thereon. The double layered type comprises a photoconductive layer consisting of the layer of a charge carrier producing pigment (hereinafter referred to as "charge carrier producing layer") and the layer of a charge transporting material (hereinafter referred to as "charge transporting layer"), and an electroconductive support material for supporting the photoconductive layer thereon. Here, the charge carrier producing layer can be placed on the charge transporting layer or vice versa.

Figure 2:
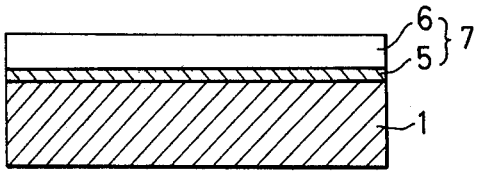
FIG. 2 is an enlarged sectional view of a double layered type electrophotographic photoconductor according to the present invention.
Figure 3:
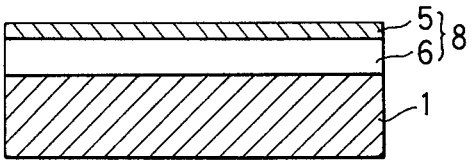
FIG. 3 is an enlarged sectional view of another double layered type electrophotographic photoconductor according to the present invention.

To be more specific, FIG. 1 shows the dispersed type electrophotographic photoconductor, and FIG. 2 and FIG. 3 shows the double layered type electrophotographic photoconductors, respectively.

In FIG. 1, reference numeral 1 represents an electroconductive supporting member and reference numeral 4 represents a photoconductive layer which comprises a charge carrier producing pigment 2 and a charge transporting medium 3 in which the particles of the charge carrier producing pigment 2 are dispersed.

In FIG. 2, reference numeral 7 represents a double layered photoconductive layer comprising a charge transporting layer 6 and a charge carrier producing layer 5, which are formed on the electroconductive supporting material 1.

In FIG. 3 which shows another double layered photoconductor, reference numeral 8 represents another double layered photoconductive layer, in which the charge transporting layer 6 and the charge carrier producing layer 5 are reversed in contrast with the photoconductive layer 7.

Both double layered electrophotographic photoconductors as shown in FIG. 2 and FIG. 3 can be employed equally, but in general, it is preferable to place the charge transporting layer 6 on the charge carrier producing layer 5 from the view point of the mechanical strength of the electrophotographic photoconductor as shown in FIG. 2.

In the case of the dispersed type electrophotographic photoconductor as shown in FIG. 1, in which the charge carrier producing pigment 2 is dispersed in the charge transporting medium 3, a higher photosensitivity can be usually attained under a positive charge application.

On the other hand, in the case of the double layered type electrophotographic photoconductos, when the charge transporting layer 6 is placed on the charge carrier producing layer 5, a higher photosensitivity can be usually attained under a negative charge application. On the other hand, when the charge carrier producing layer 5 is placed on the charge transporting layer 6, a positive charging is usually preferable for attaining a higher photosensitivity.

The reason for this phenomenon is unknown, but probably this is due to the positive hole transporting action of the charge transporting layer 6 containing any of the previously mentioned anthracene compounds. Furthermore, in general, photoconductivity includes the two phenomena of (1) production of charge and (2) transportation of charge, and in the present invention, the charge transporting action of the anthracene compounds is utilized for transporting the charge produced by the charge carrier producing pigments. However, the anthracene compounds not only transport charges but also accept charges produced by the charge carrier producing pigments, and this seems to be related to the above-mentioned combinations of the construction of the double layered type electrophotographic photoconductors and the charging polarity for attaining a high photosensitivity.

As the binder resins for use in the charge transporting layers according to the present invention, the following organic polymers can be employed: polyester, polyamide, polyurethane, polyketone, polycarbonate, vinyl polymer, poly-N-vinylcarbazole which is itself photoconductive, polyvinylpyrene, polyvinylanthracene, polyvinylbenzocarbazole, pyrene-formaldehyde resin, and bromopyrene-formaldehyde resin. These binder resins can be used in the photoconductive layer 4 in FIG. 1.

As the plasticizers for use in the binder resins, polybiphenyl chloride, dibutyl phthalate, dimethylnapthalene, and halogenated paraffin.

The dispersed type photoconductor as shown in FIG. 1 is prepared by the following procedure.

A charge carrier producing pigment and a dispersing agent, such as tetrahydrofuran are placed in a grinding apparatus, such as a ball mill. The mixture is ground in the grinder so that a pigment dispersion is prepared. To this dispersion is added an anthracene compound which serves as a charge transporting material, an appropriate binder resin, and a plasticizer, if necessary. The mixture is then mixed sufficiently so that a photoconductive mixture for coating on an electroconductive supporting material is prepared.

Alternatively, an anthracene compound, a binder resin, and an appropriate plasticizer are dissolved in a solvent, such as tetrahydrofuran. To this solution, a charge carrier pigment is added. The mixture is then ground in a grinding apparatus such as a ball mill. The thus prepared photoconductive mixture is coated on an electroconductive supporting material, such as aluminium plate, alminium evaporated plastic film, electroconductively treated paper, or other metal plate, using a doctor-blade technique, and then dried.

The weight ratio of the anthracene compound which serves as the charge transporting material in the photoconductive layer 4 is in the range of 10 to 60%, and preferably in the range of 30 to 50%, and the weight ratio of the charge carrier producing pigment 2 in the photoconductive layer 4 is in the range of 50 to 1%, and preferably in the range of 20 to 1%, and the average particle size of the charge carrier producing pigment 2 is about 5 μm or less, and preferably 2 μm or less. The thickness of the dried photoconductive layer 4 is in the range of approximately 3 μm to 100 μm, and preferably in the range of 5 μm to 30 μm.

In the case of the double layered type photoconductor as shown in FIG. 2, the charge carrier producing layer 5, which consists of only a charge carrier producing pigment or of a charge carrier producing pigment and a binder resin, is formed on an electroconductive layer by coating or evaporation and then the charge transporting layer 6 is formed containing an anthracene compound therein. It is preferable that the anthracene compound is contained in the charge transporting layer 6 in the range of 10 to 60 wt %. The thickness of the charge transporting layer 6 is in the range of 5 to 100 μm, and preferably in the range of 10 to 50 μm.

The coating liquid for forming the charge carrier producing pigment layer 5 is prepared by the following procedure. A mixture of a charge carrier producing pigment and an appropriate dispersing agent, for example, tetrahydrofuran is ground to 5 μm or less, preferably to 2 μm or less in average particle size in a grinding apparatus, such as a ball mill, so that a pigment dispersion is prepared. The thus prepared pigment dispersion is coated on an electroconductive supporting material by a doctor-blade technique. Alternatively, a charge carrier producing pigment is dissolved in a solvent, and the solution of the charge carrier producing pigment is coated on an electroconductive supporting material. By drying the electrophotographic photoconductor, the charge carrier producing pigment is caused to separate out in the form of fine crystals. In this case, when the charge carrier producing layer 5 is composed of a charge carrier producing pigment and a binder resin, the less the amount of the binder resin, the better in order not to detract from the photoconductivity of the charge carrier producing layer 5.

It is preferable that the amount of the resin binder in the charge carrier producing layer 5 be in the range of 50 to 5 wt %. The thickness of the charge carrier producing layer 5 is in the range of 0.05 μm to 20 μm, preferably in the range of 0.1 to 5 μm.

The double layered electrophotographic photoconductor as shown in FIG. 3 can be prepared in the same manner as in the case of the double layered electrophotographic photoconductor as shown in FIG. 2, except that the charge carrier producing layer 5 is formed on the charge transporting layer 6 in FIG. 3.

In the present invention, by forming a barrier layer whose thickness is in the range of 0.01 to 2 μm and which comprises a material selected from the group consisting of polyamide, polyvinyl acetate, polyurethane, and aluminium oxide on the electroconductive supporting material 1 before forming the photoconductive layer 4, 7 or 8, the adhesion of the photoconductive layer 4, 7, 8 or to the electroconductive supporting material 1 can be improved and furthermore, the charging characteristics of the photoconductor can be improved to some extent.

EXAMPLE 1

To two parts by weight of Diane Blue (C. I. 21180) were added 98 parts by weight of tetrahydrofuran. The mixture of Diane Blue and tetrahydrofuran was ground in a ball mill until the average particle size of Diane Blue became approximately 1 μm, so that a charge carrier producing pigment dispersion was prepared. This dispersion was coated on an aluminium evaporated polyester film by a doctor blade and was then air-dried at room temperature, so that a 1 μm thick charge carrier producing layer was formed on the aluminium evaporated polyester film.

Two parts by weight of 9-(4-diethylaminostyryl) anthracene, which is represented by the formula

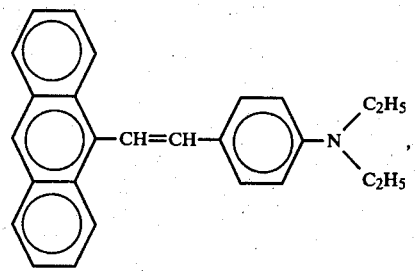

3 parts by weight of polycarbonate (Panlite L commercially available from Teijin Co., Ltd.) and 45 parts of tetrahydrofuran were mixed so that a charge transporting layer formation liquid was prepared. The thus prepared charge transporting layer formation liquid was coated on the charge carrier producing layer by a doctor blade and was then dried at 100° C. for 10 minutes so that a 9 μm thick charge transporting layer was formed on the charge carrier producing layer. Thus, an electrophotographic photoconductor according to the present invention was prepared.

The electrophotographic photoconductor was charged negatively in the dark under application of −6 kV of corona charge for 20 seconds and was then allowed to stand in the dark for 20 seconds without applying any charge thereto. At this moment, the surface potential Vpo (V) of the photoconductor was measured by Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{\frac{1}{2}}$ (lux. second) required to reduce the initial surface potential Vpo (V) to ½ the initial surface potential Vpo (V). The results showed that Vpo = −970 V and $E_{\frac{1}{2}}$ = 3.5 lux.second.

EXAMPLE 2

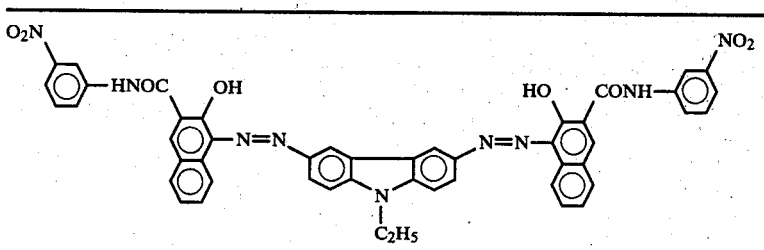

| | |
|---|---|
| (a charge carrier producing pigment) | 3 parts by weight |
| Polyester resin (Polyester Adhesive 49000 commercially available from Dupont) | 1 part by weight |
| Tetrahydrofuran | 96 parts by weight |

A mixture of the above-mentioned components was ground in a ball mill until the average particle size of the charge carrier producing pigment became approximately 1 μm, so that a charge carrier producing pigment dispersion was prepared. This dispersion was coated on an aluminium evaporated polyester film by a doctor blade and was then dried at 80° C. in a drier for 5 minutes, so that a 1 μm thick charge carrier producing layer was formed on the aluminium evaporated polyester film.

Then, two parts by weight of 10-bromo-9-(4-methoxystyryl) anthracene, which is represented by the formula,

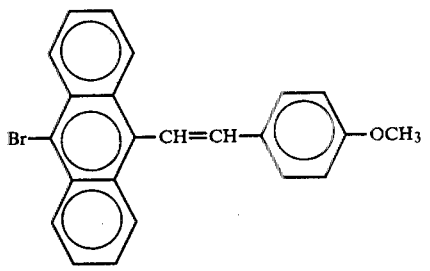

3 parts by weight of polycarbonate (Panlite L commercially available from Teijin Co., Ltd.) and 45 parts by weight of tetrahydrofuran were mixed so that a charge transporting layer formation liquid was prepared.

The thus prepared charge transporting layer liquid was coated on the charge carrier producing layer by a doctor blade and was then dried at 100° C. for 10 minutes so that a 10 μm thick charge transporting layer was formed on the charge carrier producing layer. Thus another electrophotographic photoconductor according to the present invention was prepared.

As in the case of Example, the electrophotographic photoconductor was charged negatively in the dark under application of −6 kV of corona charge for 20 seconds, and was then allowed to stand in the dark for 20 seconds without applying any charge thereto, and as in the case of Example 1, Vpo and $E_{\frac{1}{2}}$ were measured. The results showed that Vpo=−950 V and $E_{\frac{1}{2}}$=6.9 lux. second.

EXAMPLE 3

In Example 2,

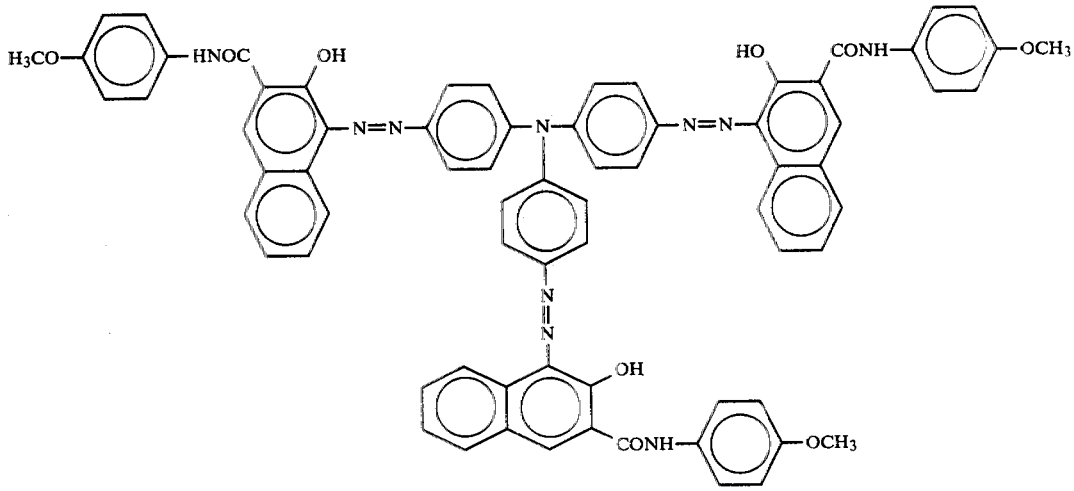

was employed as the charge carrier producing pigment, and α-3-(9-ethylcarbazoyl)β-(9-anthryl) ethylene represented by the formula

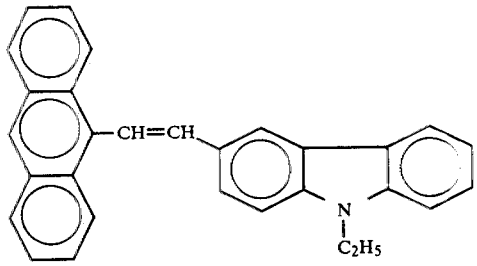

was employed as the charge transporting material, and Vpo and $E_{\frac{1}{2}}$ were measured likewise. The results showed that Vpo=−1000 V and $E_{\frac{1}{2}}$=5.0 lux.second.

EXAMPLE 4

In Example 2,

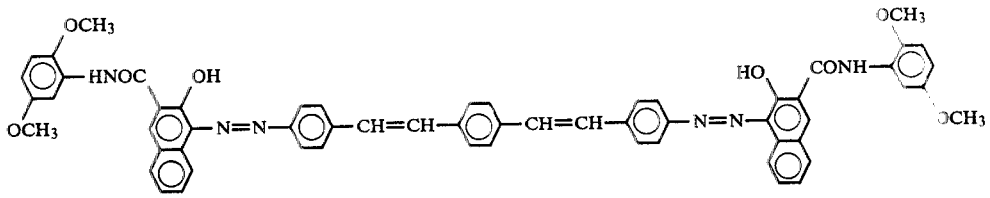

was employed as the charge carrier producing pigment, and 10-bromo-9-(4-diethylaminostyryl) anthracene represented by formula

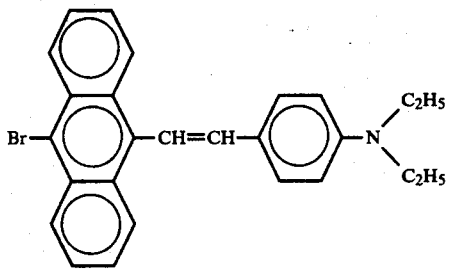

was employed as the charge transporting material, and Vpo and $E\frac{1}{2}$ were measured likewise. The results showed that Vpo = −1330 V and $E\frac{1}{2}$ = 4.7 lux.second.

EXAMPLE 5

A 1 μm thick charge carrier producing layer consisting of selenium was formed on an approximately 300 μm thick aluminium plate by vacuum evaporation. Then, two parts by weight of 9-(4-methylstyryl) anthracene represented by the formula

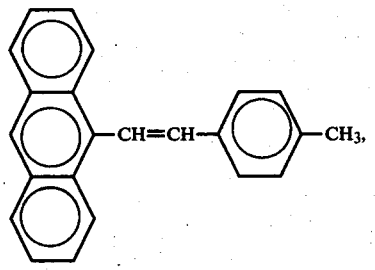

3 parts by weight of polyester resin (Polyester Adhesive 49000 commercially available from Dupont) and 45 parts by weight of tetrahydrofuran were mixed so that a charge transporting layer formation liquid was prepared. The thus prepared charge transporting formation liquid was coated on the charge carrier producing layer consisting of selenium by a doctor blade and was then air-dried at room temperature, and was further dried under reduced pressure so that a 10 μm thick charge transporting layer was formed on the charge carrier producing layer. Thus, a further electrophotographic photoconductor according to the present invention was prepared. By the same procedure as in the case of Example 1, Vpo and $E\frac{1}{2}$ were measured. The results showed that Vpo = −1060 V and $E\frac{1}{2}$ = 9.6 lux.second.

EXAMPLE 6

In Example 5, instead of selenium, a perylene pigment C. I. Vat Red 23 (C. I. 71130) represented by the formula

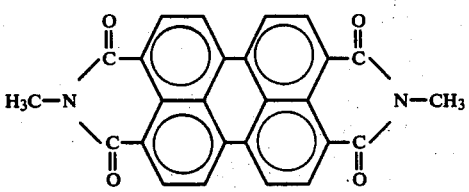

was vacuum-evaporated with the thickness of 0.3 μm on an approximately 300 μm thick aluminium plate so that a charge carrier producing layer was formed.

Then, two parts by weight of 9-(4-di-n-buthylaminostyryl) anthracene represented by the formula

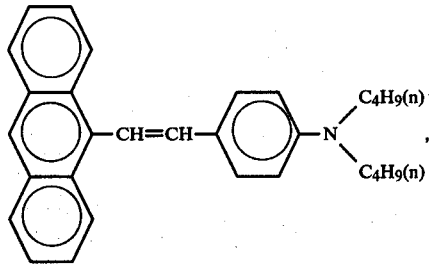

3 parts by weight of polyester resin (Polyester Adhesive 49000 commercially available from Dupont) and 45 parts by weight of tetrahydrofuran were mixed so that a charge transporting layer formation liquid was prepared. The thus prepared charge transporting layer formation liquid was coated on the charge carrier producing layer consisting of the perylene pigment by a doctor blade and was then air-dried at room temperature, and was further dried under reduced pressure so that a 10 μm thick charge transporting layer was formed on the charge carrier producing layer. Thus, a further electrophotographic photoconductor according to the present invention was prepared. By the same procedure as in the case of Example 1, Vpo and $E\frac{1}{2}$ were measured. The results showed that Vpo = −1190 V and $E\frac{1}{2}$ = 4.3 lux.second.

EXAMPLE 7

A mixture of one part by weight of Chloro Diane Blue and 158 parts by weight of tetrahydrofuran was ground in a ball mill until the average particle size of Chloro Diane Blue became approximately 1 μm. To the mixture were added 12 parts by weight of 9-(4-nitrostyryl) anthracene represented by the formula

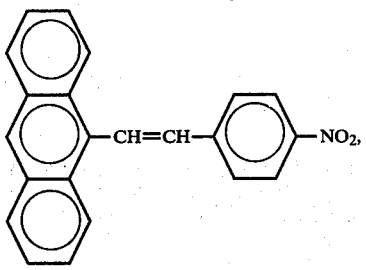

18 parts by weight of polyester resin (Polyester Adhesive 49000 commercially available from Dupont). The mixture was further mixed so that a photoconductive layer formation liquid was prepared. The thus prepared photoconductor layer formation liquid was coated on an aluminium evaporated polyester film by a doctor blade and was then dried to 100° C. for 30 minutes so that a 16 μm thick photoconductive layer was formed on the aluminium evaporated polyester film. Thus, a further electrophotographic photoconductor according to the present invention was prepared. The photoconductor was positively charged under application of +6 kV of corona charge. Under the same conditions and by use of the same paper analyzer as in Example 1, Vpo and $E_{\frac{1}{2}}$ were measured. The results showed that Vpo=1060 V and $E_{\frac{1}{2}}$=11.4 lux.second.

EXAMPLE 8

In Example 7, instead of Chloro Diane Blue,

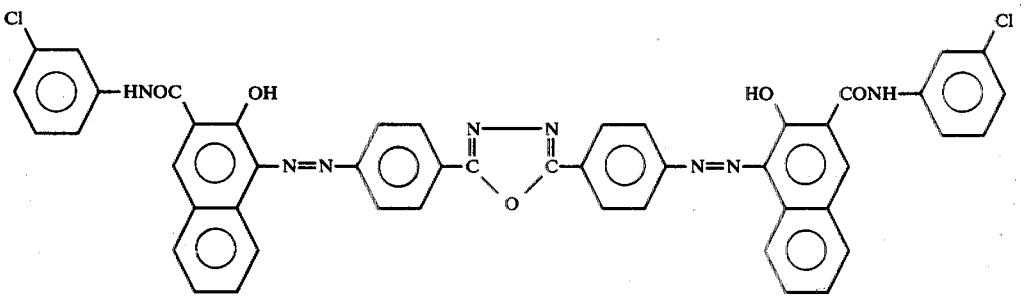

was employed as the charge carrier producing pigment, and instead of 9-(4-nitrostyryl) anthracene, 9-styryl anthracene represented by the formula

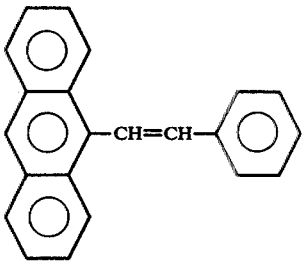

was employed. By the same procedure as in Example 7, Vpo and $E_{\frac{1}{2}}$ were measured. The results showed that Vpo=1190 V and $E_{\frac{1}{2}}$=11.8 lux.second.

EXAMPLE 9

In Example 7, instead of Chloro Diane Blue,

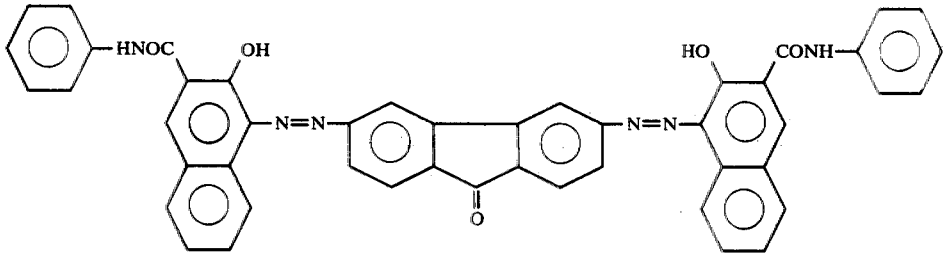

was employed as the charge carrier producing pigment, and instead of 9-(4-nitrostyryl) anthracene, 9-(4-cyanostyryl) anthracene represented by the formula

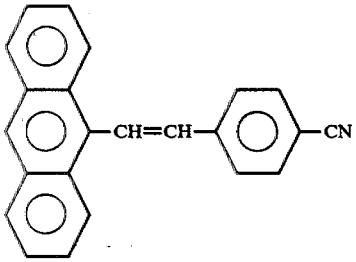

was employed. By the same procedure as in Example 7, Vpo and $E_{\frac{1}{2}}$ were measured. The results showed that Vpo=1260 V and $E_{\frac{1}{2}}$=5.6 lux.second.

EXAMPLE 10

In Example 7, instead of Chloro Diane Blue,

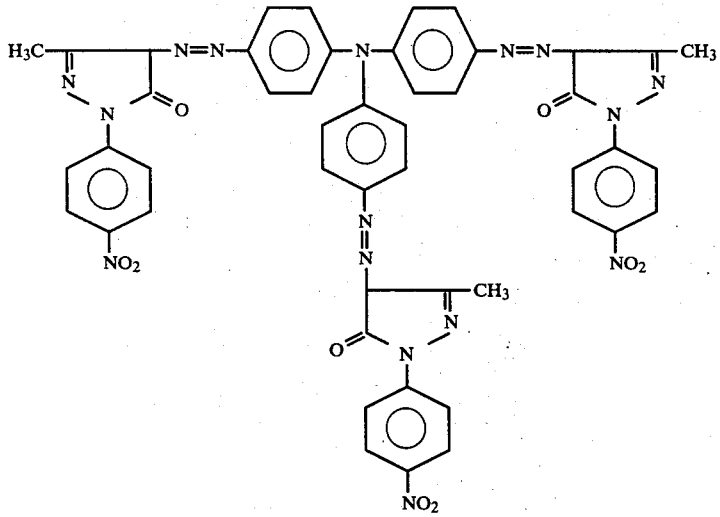

was employed as the charge carrier producing pigment, producing pigment, and instead of 9-(4-nitrostyryl) anthracene, α-(9-anthryl)β-(1-naphthyl) ethylene represented by the formula

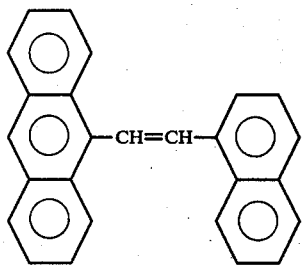

was employed. By the same procedure as in the Example 7, Vpo and $E_{\frac{1}{2}}$ were measured. The results showed that Vpo=1040 V and $E_{\frac{1}{2}}$=4.5 lux.second.

Each of the electrophotographic photoconductors prepared in Examples 1 to 6 was negatively charged by a commercially available copying machine and a latent image was formed on each photoconductor and was developed with a positively charged dry type toner. The thus developed toner image was transferred electrostatically to a high quality transfer sheet and was fixed to the transfer sheet. As a result, a clear toner image was obtained from each electrophotographic photoconductor. In the case where a wet type developer was used instead of the dry type toner, a clear image was also obtained from each photoconductor.

Furthermore, in the case of the electrophotographic photoconductors prepared in Examples 7 to 10, each photoconductor was positively charged by a commercially available copying machine and a latent image was formed on each photoconductor and was developed with a negatively charged dry type toner. The thus developed toner image was transferred electrostatically to a high quality transfer sheet and was fixed to the transfer sheet.

As a result, a clear toner image was obtained from each electrophotographic photoconductor. In the case where a wet type developer was used instead of the dry type toner, a clear image was also obtained from each photoconductor.

COMPARISON

In order to confirm the advantageous effects of the present invention, in Example 1, a charge transporting layer containing 9-(4-chlorostyryl) anthracene was formed on the electroconductive layer without forming any charge carrier producing layer, and the thus prepared photoconductor was charged in the same manner as in Example 1. The results showed that Vpo=1180 V and $E_{\frac{1}{2}}$=not less than 80 lux.second, and Vpo=1090 V and $E_{\frac{1}{2}}$=not less than 80 lux.second. These results indicate that the dark decay of the photoconductor is considerably slow irrespective of the polarity of applied charge and that the anthracene compound serves as a charge transporting material.

What is claimed is:

1. In an electrophotographic photoconductor consisting essentially of a photoconductive layer comprising a charge carrier producing pigment and a charge transporting material, and an electroconductive supporting material for supporting said photoconductive layer thereon, the improvement comprising said charge transporting material being a compound selected from the group consisting of anthracene compounds of the formula:

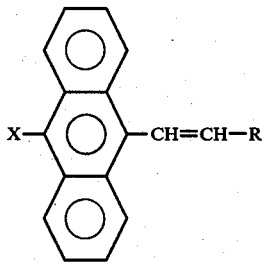

wherein X represents hydrogen or a halogen atom and R represents an unsubstituted phenyl radical, a substituted phenyl radical having a halogen substituent, a cyano substituent, a lower dialkyl amino substituent with one to four carbon atoms, a lower alkoxy substituent with one to five carbon atoms, and a nitro substituent, a naphthyl radical, an anthryl radical, and a carbazoyl radical, and said charge carrier producing pigment being an azo pigment selected from the group consisting of

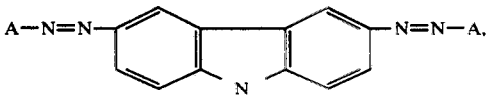

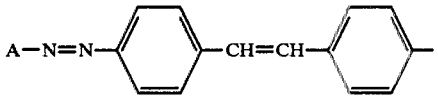

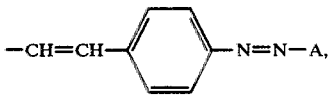

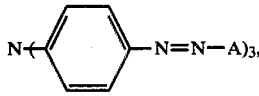

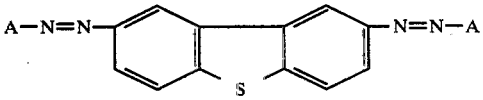

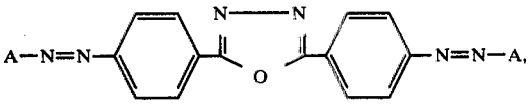

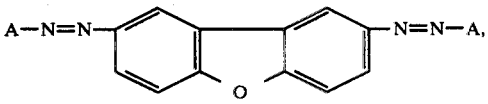

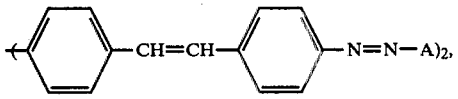

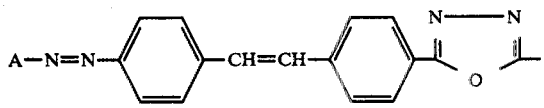

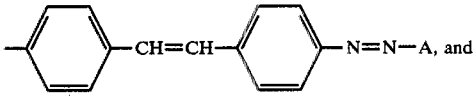

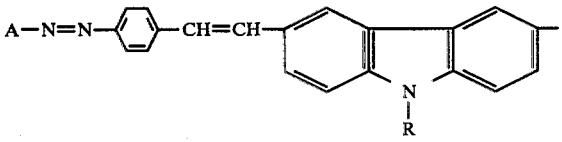

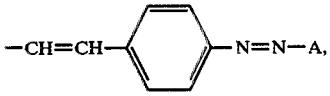

wherein substituent A of the formulas is

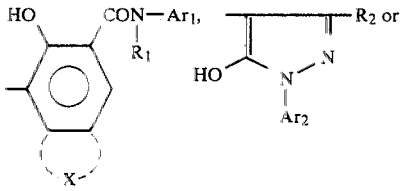

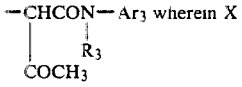

is selected from the group consisting of a hydrocarbon aromatic ring, a heterocyclic ring, substituted hydrocarbon aromatic rings and substituted heterocyclic rings; $Ar_1$ is selected from the group consisting of a hydrocarbon aromatic ring, a heterocyclic ring, substituted hydrocarbon aromatic and substituted heterocyclic rings; $Ar_2$ and $Ar_3$ are each selected from the group consisting of a hydrocarbon aromatic ring and substituted hydrocarbon aromatic rings; $R_1$ and $R_3$ are selected from the group consisting of hydrogen, lower alkyl, phenyl, substituted lower alkyl and substituted phenyl and $R_2$ is selected from the group consisting of lower alkyl, carboxyl and ester derivatives of said carboxyl group, the weight ratio of said charge transporting material in said layer ranging from 10 to 60% and the weight ratio of said charge carrier producing pigment in said layer ranging from 50% to 1%.

2. An electrophotographic photoconductor as claimed in claim 1, wherein said photoconductive layer further comprises at least one binder resin for binding said charge carrier producing pigment and said charge transporting material.

3. An electrophotographic photoconductor as claimed in claim 1, further comprising a barrier layer between said photoconductive layer and said electroconductive layer, said barrier layer serving to increase the charge acceptance of said electrophotographic photoconductor.

4. An electrophotographic photoconductor as claimed in claim 1, wherein said photoconductive layer essentially consists of a charge carrier producing layer containing said charge producing pigment, and a charge transporting layer containing said charge transporting material.

5. An electrophotographic photoconductor as claimed in claim 2, wherein the particle size of said charge carrier producing pigment in said photoconductive layer is not more than 5 $\mu$m.

6. An electrophotographic photoconductor as claimed in claim 2, wherein said binder is a material selected from the group consisting of polyester, polyamide, polyurethane, polyketone, polycarbonate, vinyl polymer, poly-N-vinylcarbazole, polyvinylpyrene, polyvinylanthracene, polyvinylbenzocarbazole, pyrene-formaldehyde resin and bromopyrene-formaldehyde resin.

7. An electrophotographic photoconductor as claimed in claim 2, wherein the thickness of said photoconductive layer is in the range of 3 to 100 $\mu$m.

8. An electrophotographic photoconductor as claimed in claim 3, wherein said barrier layer comprises at least one material selected from the group consisting of polyamide, polyvinyl acetate, polyurethane and aluminium oxide.

9. An electrophotographic photoconductor as claimed in claim 4, wherein said charge transporting layer is formed on said charge carrier producing layer.

10. An electrophotographic photoconductor as claimed in claim 4, wherein said charge carrier producing layer is formed on said charge transporting layer.

11. An electrophotographic photoconductor as claimed in claim 4, wherein at least said charge transporting layer contains a binder resin selected from the group consisting of polyester, polyamide, polyurethane, polyketone, polycarbonate, vinyl polymer, poly-N-vinylcarbazole, polyvinylbenzocarbazole, pyrene-formaldehyde resin and bromopyrene-formaldehyde resin.

12. An electrophotographic photoconductor as claimed in claim 4, wherein the weight ratio of said charge transporting material in said photoconductive layer is in the range of 10 to 60 percent.

13. An electrophotographic photoconductor as claimed in claim 4, wherein the thickness of said charge transporting layer is in the range of 5 to 100 μm, and the thickness of said charge carrier producing layer is in the range of 0.05 to 20 μm.

14. An electrophotographic photoconductor as claimed in claim 4, wherein the average particle size of said charge carrier producing pigment is not more than 5 μm.

* * * * *

UNITED STATES PATENT AND TRADEMARK OFFICE

CERTIFICATE OF CORRECTION

PATENT NO. : 4,363,859

DATED : December 14, 1982

INVENTOR(S) : MASAOMI SASAKI ET AL

It is certified that error appears in the above-identified patent and that said Letters Patent is hereby corrected as shown below:

In the Abstract, last line on page 1, delete "radial" and insert therefor--radical--;

In column 3, line 1, delete "carboz-" and insert therefor--carbaz- --;

In column 4, line 5, after "methylstyryl" insert ")";

In column 6, figure #1, delete entire figure and insert therefor-- 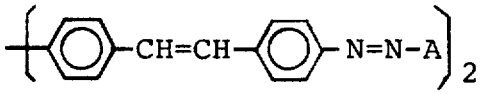 --;

UNITED STATES PATENT AND TRADEMARK OFFICE

CERTIFICATE OF CORRECTION

PATENT NO. : 4,363,859

DATED : December 14, 1982

INVENTOR(S) : MASAOMI SASAKI ET AL

It is certified that error appears in the above-identified patent and that said Letters Patent is hereby corrected as shown below:

In column 6, line 21, delete " 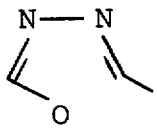 " and insert therefor-- 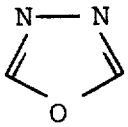 --;

In column 6, line 25, delete "distrylcabazole" and insert therefor--distrylcarbazole--;

In column 7, line 38, delete "photoconductos," and insert therefor--photoconductors,--;

In column 11, line 61, after "Example" insert "1";

UNITED STATES PATENT AND TRADEMARK OFFICE

CERTIFICATE OF CORRECTION

PATENT NO. : 4,363,859

DATED : December 14, 1982

INVENTOR(S) : MASAOMI SASAKI ET AL

It is certified that error appears in the above-identified patent and that said Letters Patent is hereby corrected as shown below:

In column 17, line 24, delete "producing pigment,";

In column 18, line 31, delete "Vpo=1180 V" and insert therefor--Vpo=-1180 V--;

In column 18, line 32, delete "Vpo=1090 V" and insert therefor--Vpo=+1090 V--;

In column 19, figure #5, delete entire figure and insert therefor--

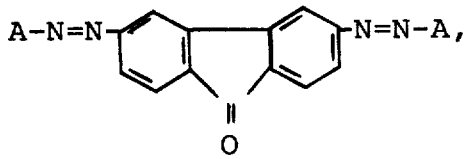

Signed and Sealed this

Twentieth Day of September 1983

[SEAL]

Attest:

GERALD J. MOSSINGHOFF

Attesting Officer

Commissioner of Patents and Trademarks